US008556347B2

(12) United States Patent
Lin et al.

(10) Patent No.: US 8,556,347 B2
(45) Date of Patent: Oct. 15, 2013

(54) SIT/STAND ASSISTANCE DEVICE

(75) Inventors: Yun-Chen Lin, Taipei (TW); Wen-Yi Huang, Taipei (TW); Chia-Chi Chen, Taipei (TW)

(73) Assignee: Fu Burg Industrial Co., Ltd., Taipei (TW)

( * ) Notice: Subject to any disclaimer, the term of this patent is extended or adjusted under 35 U.S.C. 154(b) by 920 days.

(21) Appl. No.: 12/588,417

(22) Filed: Oct. 15, 2009

(65) Prior Publication Data

US 2010/0095453 A1 Apr. 22, 2010

(30) Foreign Application Priority Data

Oct. 17, 2008 (TW) ..... 97218635 U

(51) Int. Cl.
*A47C 1/00* (2006.01)

(52) U.S. Cl.
USPC ..... 297/334; 4/667; 4/562.1; 297/DIG. 10

(58) Field of Classification Search
USPC ..... 297/DIG. 10, 331, 334, 335; 4/667, 4/560.1, 561.1, 562.2, 563.1, 564.1, 4/565.1, 566.1
See application file for complete search history.

(56) References Cited

U.S. PATENT DOCUMENTS 3,473,174 A * 10/1969 Cool ..... 4/667
4,639,037 A * 1/1987 Maruyama et al. ..... 297/334
4,821,348 A * 4/1989 Pauna ..... 4/547
5,027,446 A * 7/1991 Robertson ..... 4/254
5,063,617 A * 11/1991 Ward et al. ..... 4/667
5,189,739 A * 3/1993 Thierry ..... 4/254
5,309,583 A * 5/1994 White et al. ..... 4/667
5,328,239 A * 7/1994 Yamazaki ..... 297/333
5,737,780 A * 4/1998 Okita et al. ..... 4/667
5,772,226 A * 6/1998 Bobichon ..... 280/250.1
6,067,674 A * 5/2000 Moser ..... 4/667
6,360,382 B1 * 3/2002 Karash ..... 4/667
6,382,491 B1 * 5/2002 Hauser et al. ..... 296/65.05
6,385,797 B1 * 5/2002 Phillips ..... 4/667
6,507,961 B1 * 1/2003 Ming-Hwa ..... 4/667
6,527,341 B1 * 3/2003 Martin ..... 297/332
6,598,246 B1 * 7/2003 Shou ..... 4/667
8,056,158 B2 * 11/2011 Henshaw et al. ..... 4/667
8,438,675 B2 * 5/2013 Henshaw et al. ..... 4/667
2006/0048296 A1 * 3/2006 Sutou et al. ..... 4/667
2006/0207020 A1 * 9/2006 Huff ..... 4/667
2008/0038107 A1 * 2/2008 Henshaw et al. ..... 414/816
2011/0221239 A1 * 9/2011 Holdampf et al. ..... 297/61
2012/0054957 A1 * 3/2012 Henshaw et al. ..... 4/667

* cited by examiner

*Primary Examiner* — David E Allred
(74) *Attorney, Agent, or Firm* — Rosenberg, Klein & Lee

(57) ABSTRACT

A sit/stand assistance includes a seat, a frame, a lifting device, and a driving device. This lifting device has a fixed portion connected to the frame and a movable portion pivoted with the seat so as to move the seat up or down. The driving device includes a link, a power portion, and a working rod. One of the power portion and the working rod is pivoted with the link. The other one is pivoted with the frame. When the power portion pushes the working rod, the working rod extends out so as to make said seat moving up or tilting. Hence, it can assist a user from a seated position to a standing position. So, it matches a user's continuous sit-to-stand motion. Plus, it can be directly applied on an existing flush toilet.

3 Claims, 8 Drawing Sheets

SIT/STAND ASSISTANCE DEVICE

BACKGROUND OF THE INVENTION

1. Field of the Invention

The present invention relates to a sit/stand assistance device. It matches a user's continuous sit-to-stand motion. In addition, it can be directly applied on an existing flush toilet.

2. Description of the Prior Art

Some of the flush toilets are equipped with auxiliary handles (not shown) fixed on a wall in a public building or in a hospital. So, the physically disadvantaged persons, elders or patients can use them. However, the traditional auxiliary handles are fixed. It cannot move up or down (or change its tilting angle). Therefore, it is not an ideal design for the elders or patients because the holding position might not match the user. For a seriously physically disadvantaged person, this person often encounters difficulty in sit-to-stand (or stand-to-sit) process, because this person has no enough strength to pull one's body up by oneself.

There are some toilet seats (not shown) can be lifted up or down. But, the entire mechanism is extremely complicated and it is very expensive. It is not common in the current market. Besides, without an auxiliary pushing force, the user needs to hold on to the fixed auxiliary handle to assist oneself standing up (leaving the toilet pad).

If somebody designs a tiltable toilet pad (not shown), it seems helpful for a user to stand up. However, under this condition, the height of the toilet pad still remains unchanged. If the user's legs are weak, it is hard to stand up. Unless the user has a strong arm to push one's body up, it is difficult for the user to stand up from a seated position.

There is no any toilet sit to stand assistance product that can tilt and move up/down at the same time. For a weak user, there is no easy-to-operate, safe and comfortable product that can be used.

SUMMARY OF THE INVENTION

The primary object of the present invention is to provide a sit/stand assistance device. It matches a user's continuous sit-to-stand motion.

The next object of the present invention is to provide a sit/stand assistance device. In which, it can be directly applied on an existing flush toilet.

In order to achieve these objects, this invention is provided. The sit/stand assistance device comprising:

a seat having a first pivoting portion and a second pivoting portion;

a frame;

a lifting device having a fixed portion and a movable portion; one of the fixed portion and the movable portion being disposed with the frame; the other one being disposed with the first pivoting portion so as to move the seat up or down;

a driving device having a link, a power portion, and a working rod; the link having two ends, one end of the link being pivoted on the second pivoting portion of the seat, the other end of the link being pivoted with the frame; one of the power portion and the working rod being pivoted with the link, the other one being pivoted with the frame; when the power portion pushes the working rod, the working rod extends out so as to make the seat moving up and tilting.

DETAILED DESCRIPTION OF THE PREFERRED EMBODIMENT

Figure 1:
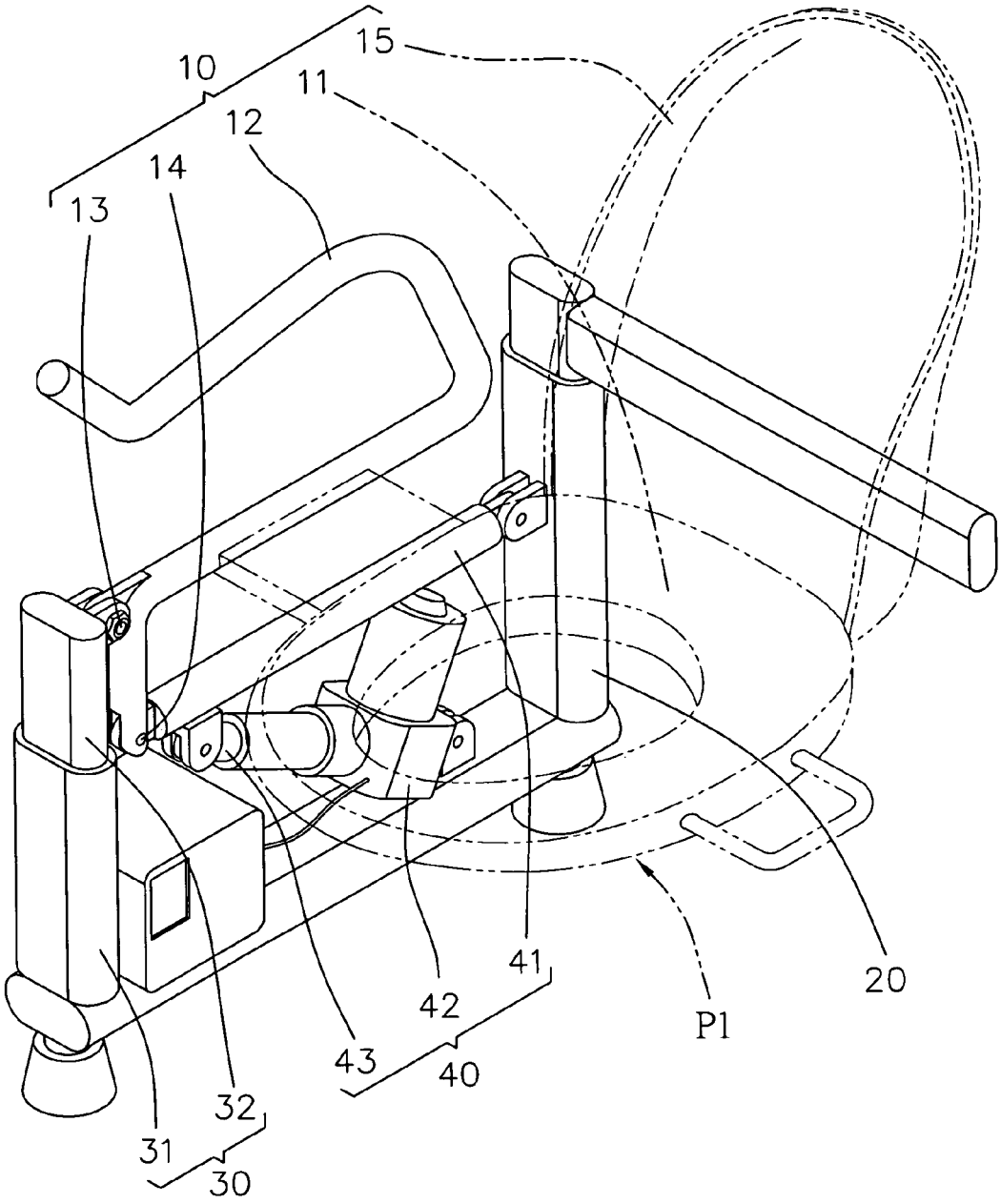
FIG. 1 is a perspective view of a preferred embodiment of the present invention.
Figure 3:
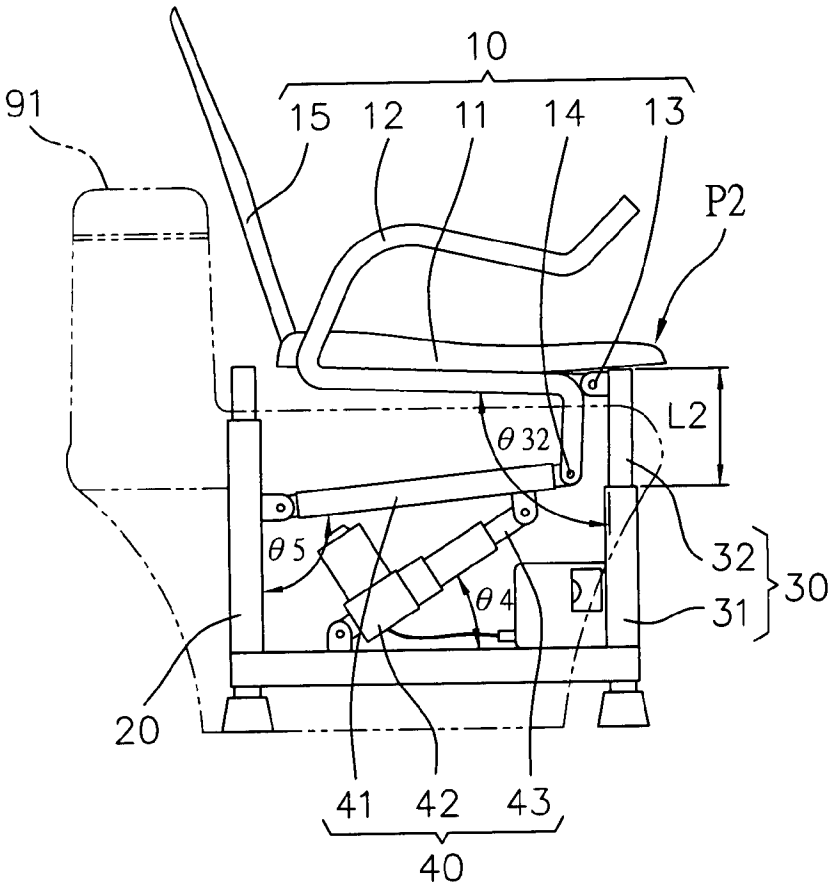
FIG. 3 shows process two of the present invention.
Figure 2:
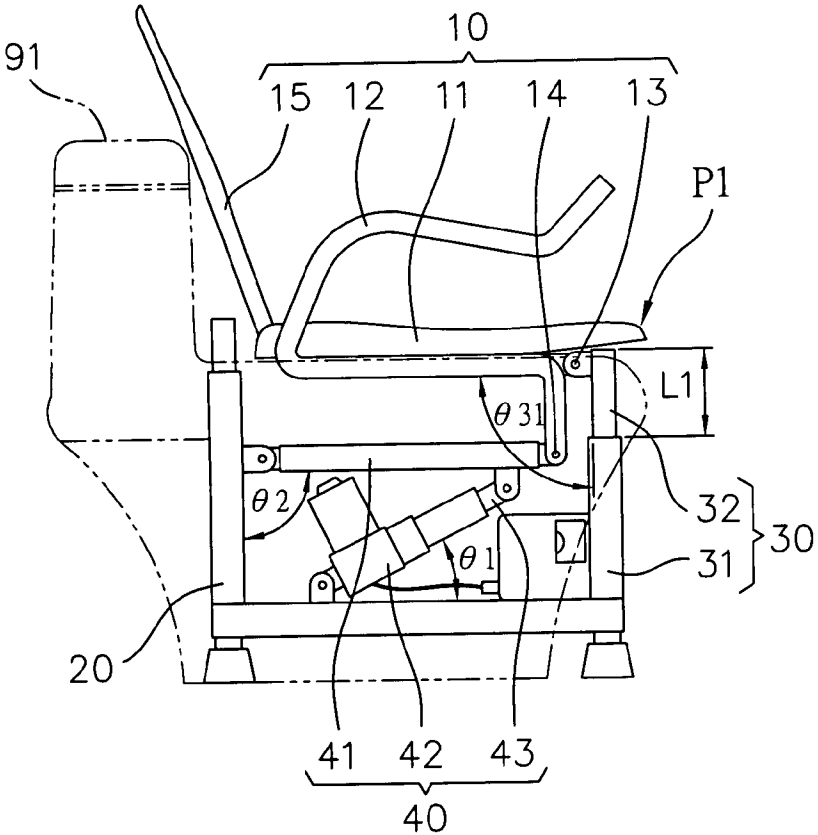
FIG. 2 shows process one of the present invention.
Figure 5:
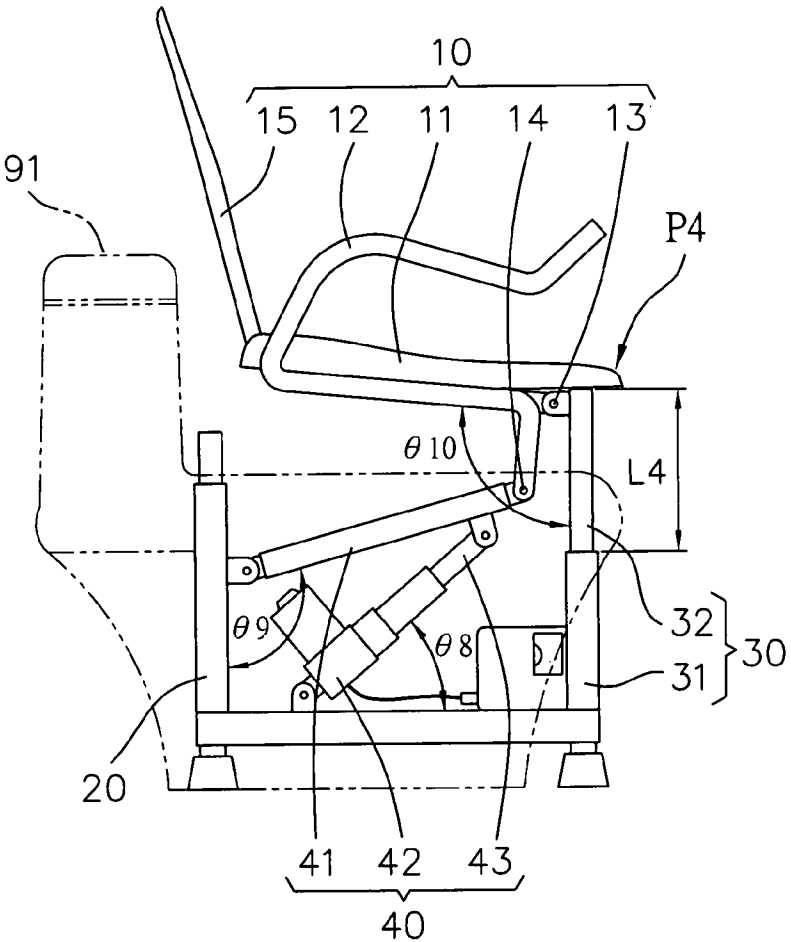
FIG. 5 shows process four of the present invention.
Figure 4:
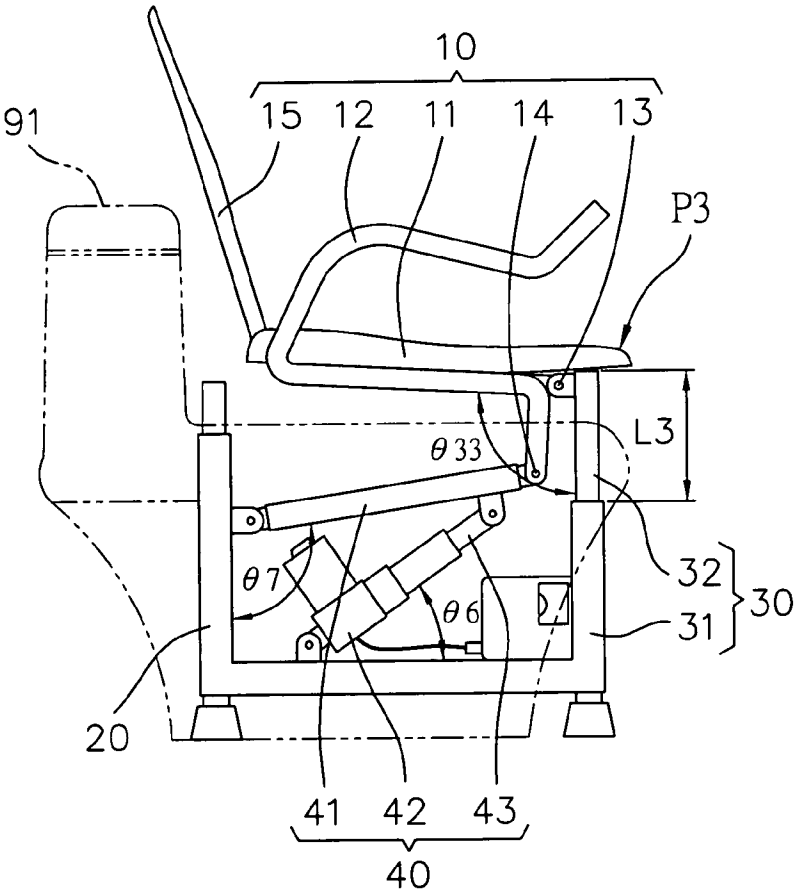
FIG. 4 shows process three of the present invention.
Figure 7:
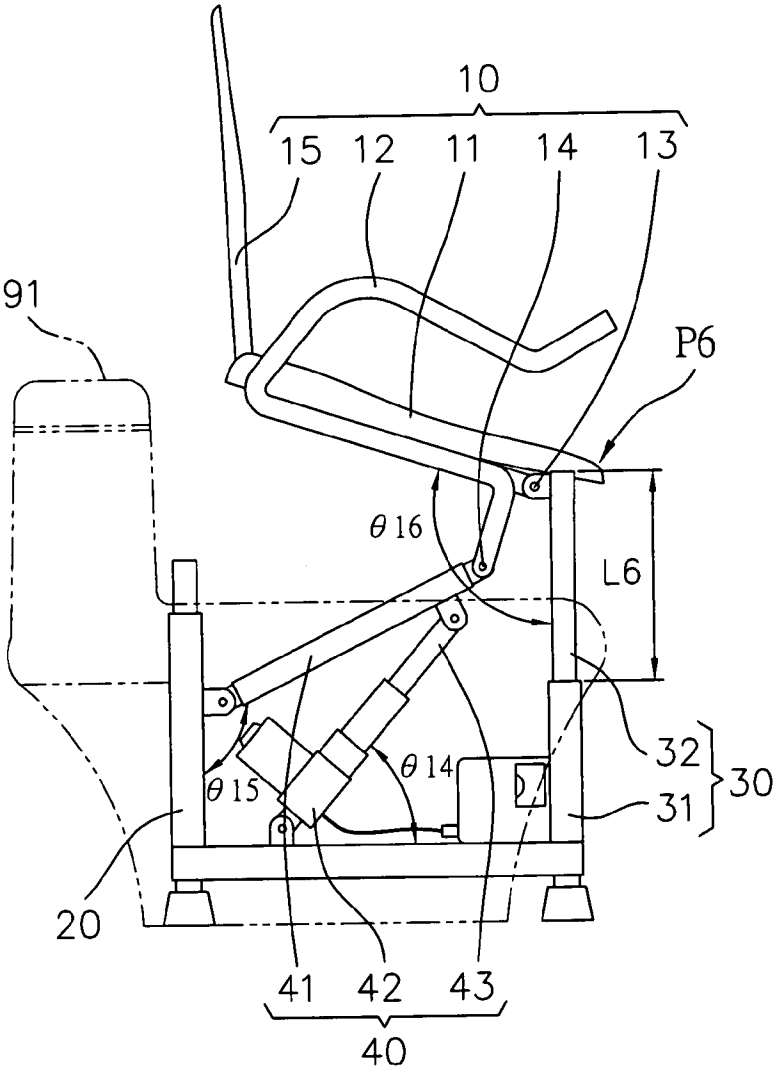
FIG. 7 shows process six of the present invention.
Figure 6:
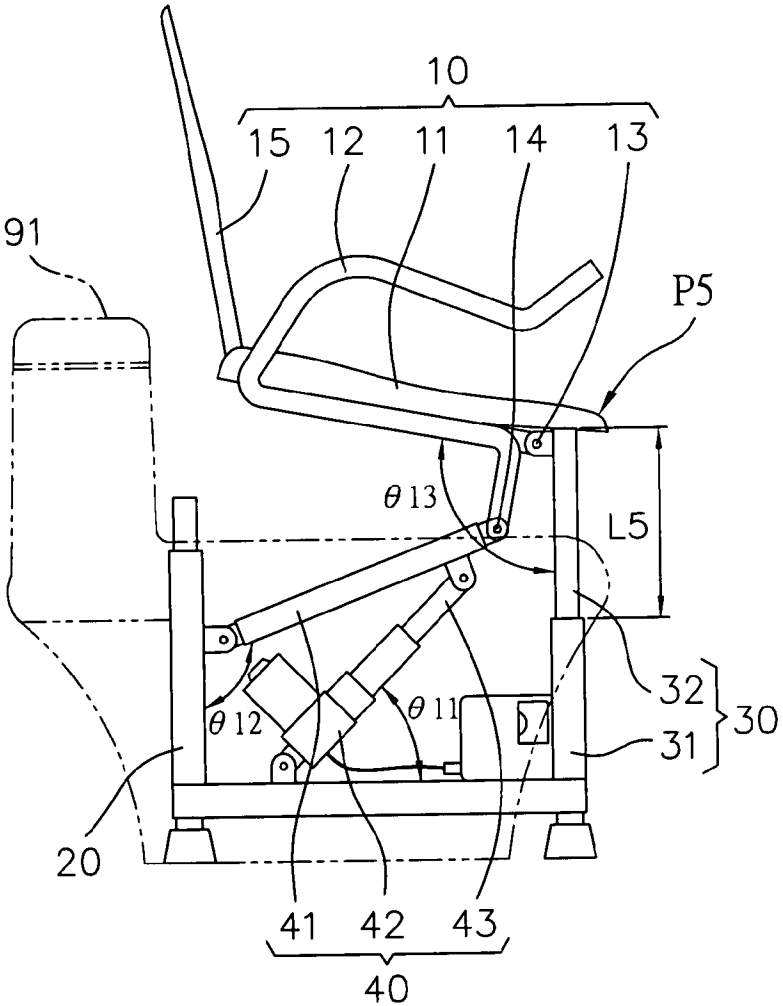
FIG. 6 shows process five of the present invention.
Figure 8A:
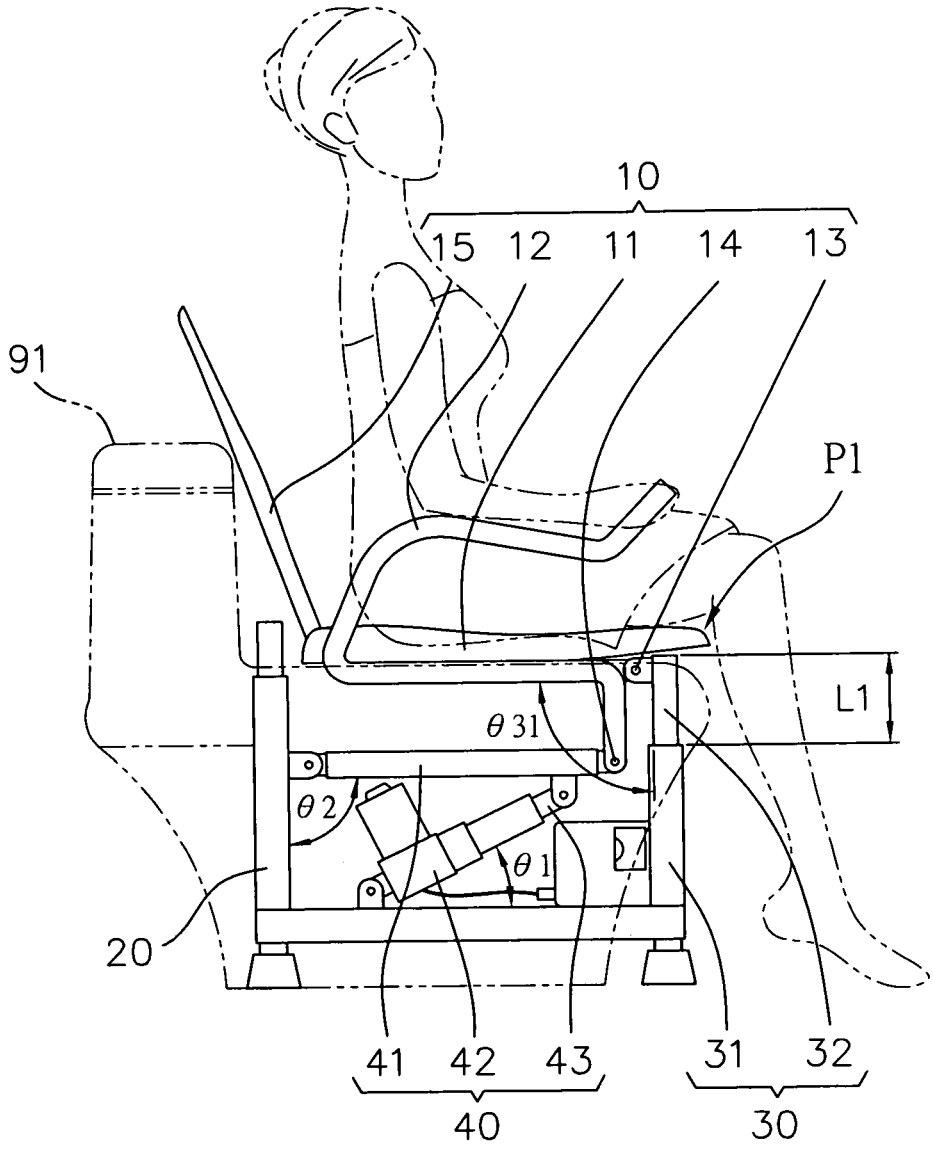
FIG. 8A illustrates the condition before the invention assists the user standing up.
Figure 8B:
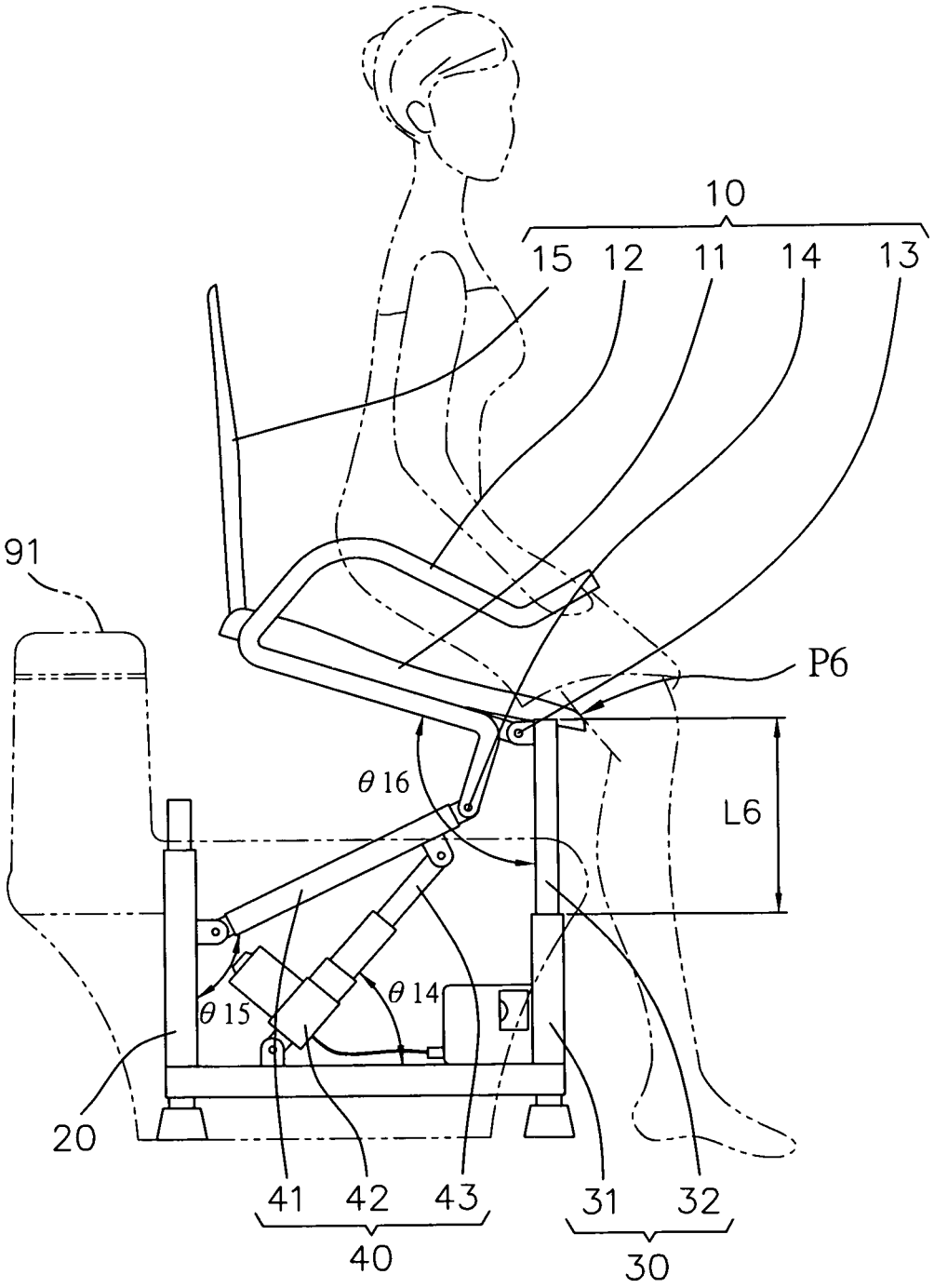
FIG. 8B illustrates the condition after the invention assists the user standing up.

FIGS. 1 and 2 show the first preferred embodiment of the present invention which is a sit/stand assistance device. The sit/stand assistance device mainly comprises a seat 10, a frame 20, a lifting device 30, and a driving device 40.

About this seat 10, it has a first pivoting portion 13 and a second pivoting portion 14.

The frame 20 can be called a base 20.

With regard to the lifting device 30, it has a fixed portion 31 and a movable portion 32. One of the fixed portion 31 and the movable portion 32 is connected with the frame 20. The other one is pivoted with the first pivoting portion 13 of the seat 10 so, as to move the seat 10 up or down.

Concerning this driving device 40, it includes a link 41, a power portion 42, and a working rod 43.

The link 41 has two ends. One end of the link 41 is pivoted on the second pivoting portion 14 of the seat 10. The other end of the link 41 is pivoted with the frame 20.

One of the power portion 42 and the working rod 43 is pivoted with the link 41. The other one is pivoted with the frame 20 (or any fixed part). When the power portion 42 pushes the working rod 43, the working rod 43 extends out so as to make said seat 10 moving up and tilting.

In addition, this seat 10 may further comprise:

a seat pad 11;

an auxiliary handle 12, mounted on the frame 11; and a seat cover 15 secured on the seat pad 11 or the auxiliary handle 12.

The seat pad 11 and the auxiliary handle 12 are provided for a stable and comfortable sitting environment for a user. The seat cover 15 can be covered on the seat pad 11 optionally.

The power portion 42 is selected from a motor, a hydraulic cylinder, or a pneumatic cylinder. Of course, the user can use any device that can generate a driving force.

One of the power portion 42 and the working rod 43 is pivoted with the link 41. The other one is pivoted with the frame 20, the ground (not shown), or any fixed part.

As shown in FIGS. 2, 3, 4, 5, 6, 7, 8A and 8B, when a user turns on the driving device 40, the power portion 42 pushes the working rod 43. Meanwhile, the link 41 also extends out and then the link 41 makes the seat pad 11 moving up. The first pivoting portion 13 works as rotating axis. Under this circumstance, the following movements are generated:

[a] The angle between the power portion 42 and the frame 20 can be varied from a first angle θ1, a fourth angle θ4, a sixth angle θ6, an eighth angle θ8, an eleventh angle θ11, to a fourteenth angle θ14.

[b] The angle between the link 41 and the frame 20 can be varied from a second angle θ2, a fifth angle θ5, a seventh angle θ7, an ninth angle θ9, an twelfth angle θ12, to a fifteenth angle θ15.

[c] Another angle between the seat 10 (and the seat pad 11) and the movable portion 32 can be varied from a third before-moving angle θ31, a third during-moving angle θ32, a third after-moving angle θ33, a tenth angle θ10, a thirteenth angle θ13, to a sixteenth angle θ16.

[d] The length between the seat pad 11 (of the seat 10) and the top of the fixed portion 31 can be varied from a first length L1, a second length L2, a third length L3, a fourth length L4, a fifth length L5, to a sixth length L6.

[e] The seat pad 11 can move to different positions, particularly from an original position P1, a first lift-up position P2, a second lift-up position P3, a third lift-up position P4, a fourth lift-up position P5, to a supporting position P6.

According to the above process, this invention can assist a user to stand up from a sitting condition.

Of course, if the user wants to use this invention to assist this user to sit down from a standing condition, the previous processes can be reversed. Related descriptions are omitted.

Figure 9:
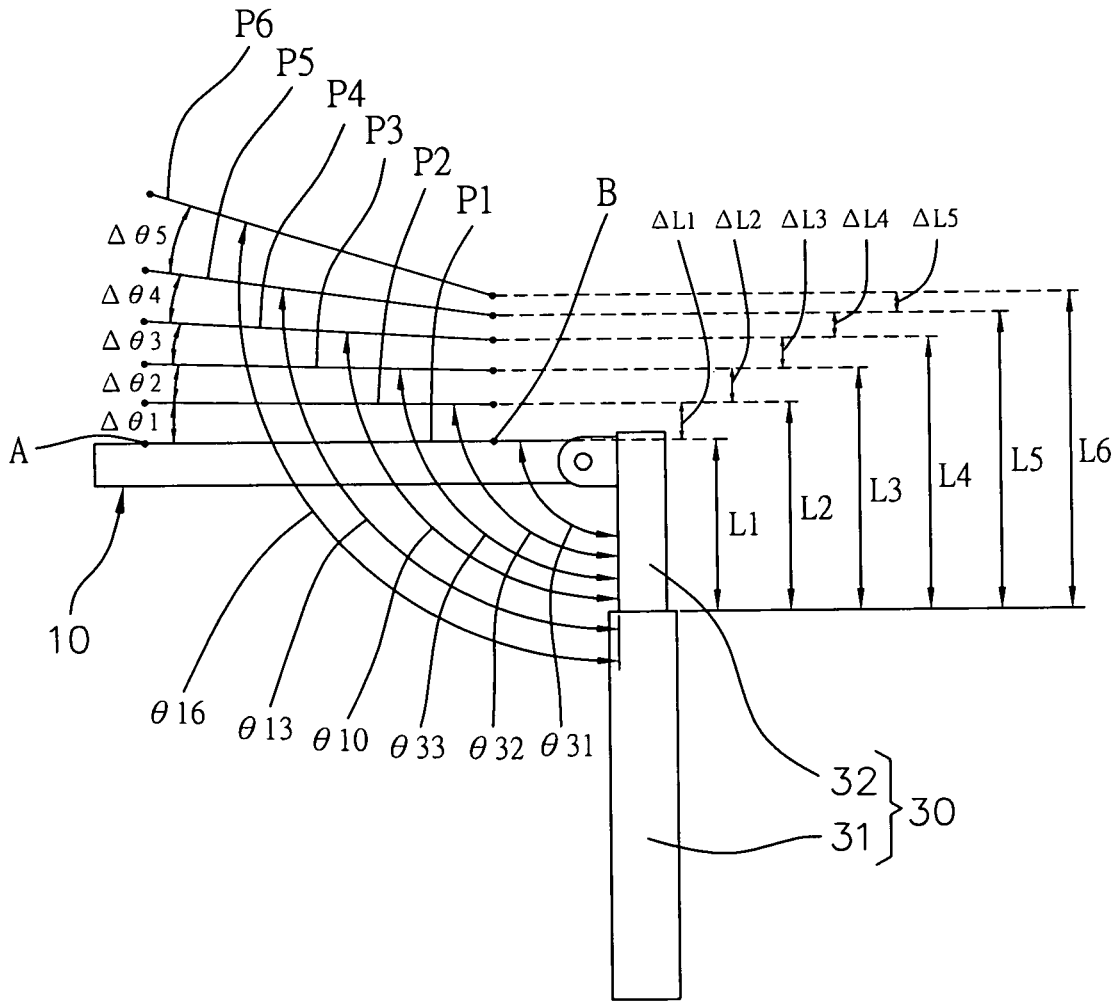
FIG. 9 shows the motions with different lifting heights and tilting angles.

As illustrated in FIG. 9, it is assumed there is a line AB on this seat 10. The line AB is used for exhibiting the position and the titling angle of the seat during different processes when this seat 10 moves up. The detailed analysis is listed below:

a first angle increment Δθ1<a second angle increment Δθ2<a third angle increment Δθ3<a fourth angle increment Δθ4<a fifth angle increment Δθ5;

a first length increment ΔL1>a second length increment ΔL2>a third length increment ΔL3>a fourth length increment ΔL4>a fifth length increment ΔL5.

FIG. 9 shows several positions of the seat 10 during this movement. From the original position P1 to the third lift-up position P4, this seat 10 moves up quickly so as to help the user to reach a height for standing up. From third lift-up position P4 to a supporting position P6, the tilting angle increases quickly so as to help the user to tilt one's body forward for standing up.

In addition, usually a flush toilet is disposed at a corner of a bathroom (to save space). The first preferred embodiment is a single side design (FIG. 1 shows this invention is installed at the right side of the flush toilet; however, it can be changed to be installed at the left side instead). If the space is enough, this invention can be modified as a two-side design. It is just an equivalent modification.

Figure 10:
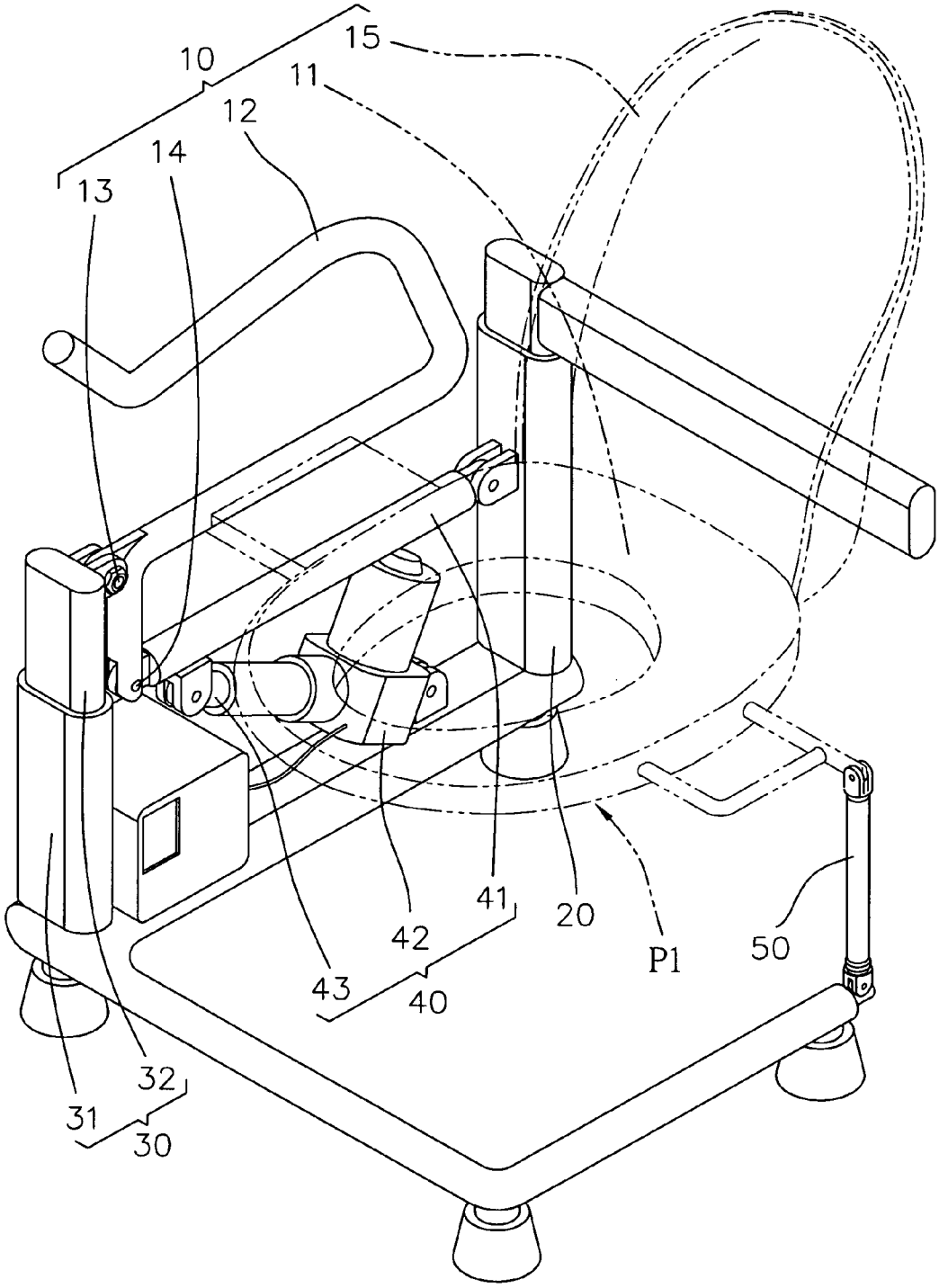
FIG. 10 is another preferred embodiment of the present invention.

Referring to FIG. 10, it shows the second preferred embodiment of this invention. The difference between the first and the second embodiments is that it further comprises:

An auxiliary lifting device 50 for pushing up the seat with said driving device 40 synchronously; the auxiliary lifting device 50 having two ends, one end being pivoted with a side of the seat pad 11 opposite to the auxiliary handle 12, the other end being pivoted with the frame 20.

The advantages and functions of this invention can be summarized as follows.

[1] It matches a user's continuous sit-to-stand motion. In the first stage, by utilizing the quickly moving up and gradually tilting movement, this invention helps a user to achieve a sit-to-stand motion. In the second stage, it gradually moves up a little bit but it tilts quickly, so that a user will be moderately pushed forward. Hence, this invention has the moving-up and tilting function for assisting a user standing up. Of course, it can assist a user to sit down by reversed process.

[2] It can be directly applied on an existing flush toilet. When this invention is installed, it does not need to break or modify the existing toilet structure. So, it saves time and work for such installation.

While this invention has been particularly shown and described with references to the preferred embodiments thereof, it will be understood by those skilled in the art that various changes or modifications can be made therein without departing from the scope of the invention by the appended claims.

What is claimed is:

1. A sit/stand assistance device comprising:

a seat having a first pivoting portion and a second pivoting portion; and a seat pad fixed to the first and second pivot portions a frame;

a lifting device having a fixed portion and a movable portion telescopically or linearly guided in the fixed portion, the movable portion being able to retract or extend from the fixed portion; one of the fixed portion or the movable portion being coupled to said frame, the other one being coupled to said first pivoting portion so as to move said seat in a substantially vertical up or down direction while the seat pad remains in a generally horizontal orientation during a first sequence of movements;

a driving device having a link, a power portion, and a working rod; said link having two ends, one end of said link being pivoted on the second pivoting portion of said seat, the other end of said link being pivoted relative to said frame; one of said power portion and said working rod being pivoted relative to said link, the other one being pivoted relative to said frame; wherein when said power portion pushes said working rod, said working rod extends out so as to move and tilt said seat pad;

wherein a change in a tilting angle of the seat pad during a second sequence of movements is larger than a change in a tilting angle during a first sequence of movements.

2. The sit/stand assistance device as claimed in claim 1, wherein:

said seat further comprising:

an auxiliary handle, mounted on said frame;

said power portion being selected from of a motor, a hydraulic cylinder, or a pneumatic cylinder;

one of said power portion and said working rod being pivoted relative to said frame or a ground.

3. The sit/stand assistance device as claimed in claim 1, wherein:

said seat further comprising: an auxiliary handle, mounted on said frame; and an auxiliary lifting device for pushing up said seat with said driving device synchronously; said auxiliary lifting device having two ends, one end being pivoted with a side of said seat pad opposite to said auxiliary handle, the other end being pivoted with said frame.

* * * * *